US009273837B2

(12) United States Patent
Nopper

(10) Patent No.: US 9,273,837 B2
(45) Date of Patent: Mar. 1, 2016

(54) LUMINAIRE WITH A LENGTH-VARIABLE SUPPORTING STRUT FOR A LIGHT-EMITTING MEANS

(75) Inventor: Hans Nopper, Cologne (DE)

(73) Assignee: IULITE GMBH (DE)

( * ) Notice: Subject to any disclaimer, the term of this patent is extended or adjusted under 35 U.S.C. 154(b) by 452 days.

(21) Appl. No.: 13/641,386

(22) PCT Filed: Apr. 16, 2010

(86) PCT No.: PCT/EP2010/055064
§ 371 (c)(1),
(2), (4) Date: May 7, 2013

(87) PCT Pub. No.: WO2011/127986
PCT Pub. Date: Oct. 20, 2011

(65) Prior Publication Data
US 2015/0092427 A1 Apr. 2, 2015

(51) Int. Cl.
*F21S 6/00* (2006.01)
*F21V 21/22* (2006.01)
*F21V 21/26* (2006.01)

(52) U.S. Cl.
CPC .. *F21S 6/00* (2013.01); *F21S 6/003* (2013.01); *F21V 21/22* (2013.01); *F21V 21/26* (2013.01)

(58) Field of Classification Search
CPC ..... F21S 6/00; F21V 21/22
See application file for complete search history.

(56) References Cited

U.S. PATENT DOCUMENTS

| | | | | |
|---|---|---|---|---|
| 4,706,172 | A | 11/1987 | Lebowitz | |
| 5,001,617 | A * | 3/1991 | Chan | 362/401 |
| 5,016,153 | A * | 5/1991 | Gismondi et al. | 362/402 |
| 5,065,297 | A * | 11/1991 | Santambrogio | 362/413 |
| 5,169,226 | A * | 12/1992 | Friedman | 362/190 |
| 7,699,492 | B2 * | 4/2010 | Levine | 362/191 |
| 2011/0063818 | A1 * | 3/2011 | Huang et al. | 362/20 |

FOREIGN PATENT DOCUMENTS

| | | |
|---|---|---|
| DE | 29706090 | 5/1997 |
| DE | 20210215 | 6/2003 |
| GB | 2435507 | 8/2007 |

OTHER PUBLICATIONS

ISR PCT EP2010 055064 dated Dec. 27, 2010.

* cited by examiner

*Primary Examiner* — Elmito Breval
(74) *Attorney, Agent, or Firm* — Cantor Colburn LLP

(57) ABSTRACT

The present invention relates to a luminaire 100 comprising a luminaire base 1, an elongate, length-adjustable supporting strut 2 held by means of the luminaire base 1, and a lighting means 3 arranged on the supporting strut 2.

8 Claims, 5 Drawing Sheets

Fig. 1
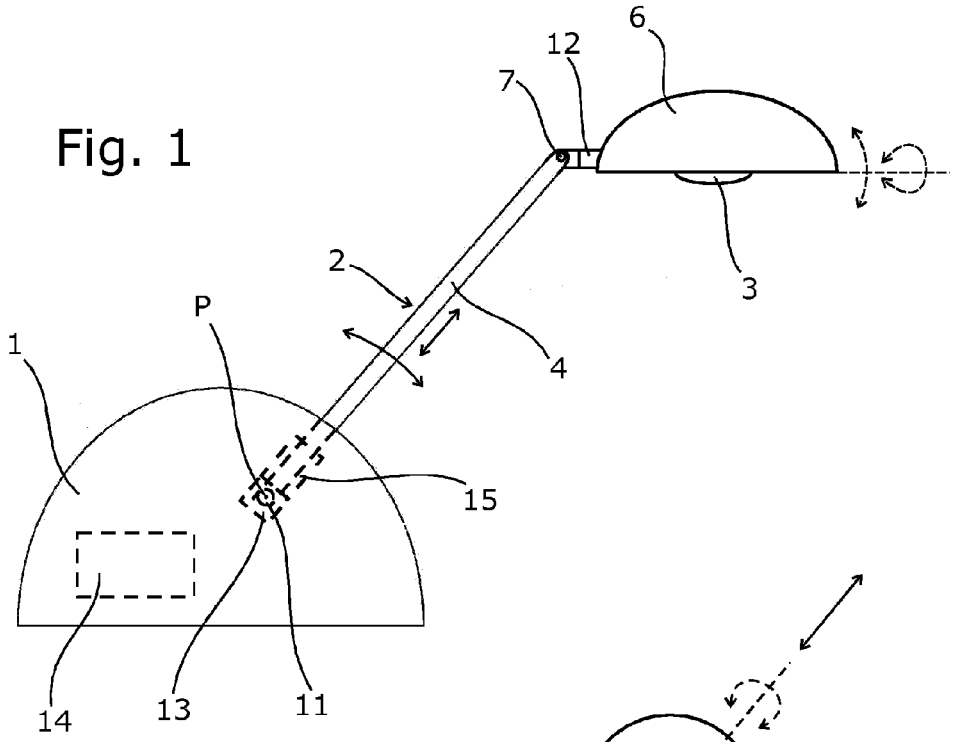
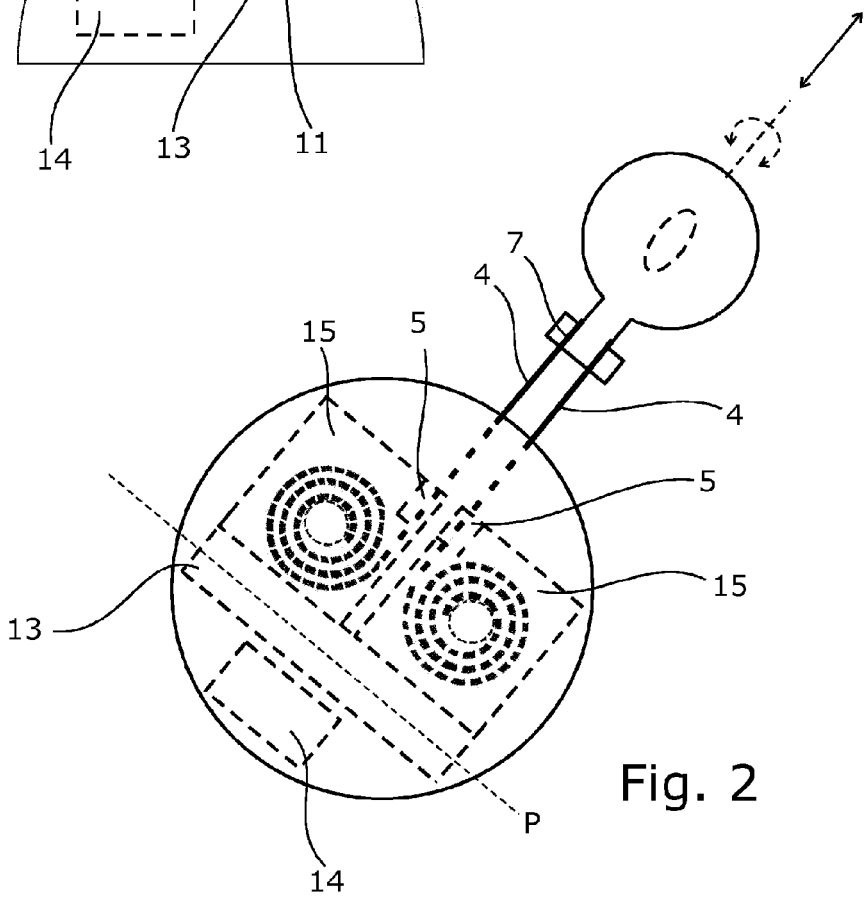
Fig. 2

LUMINAIRE WITH A LENGTH-VARIABLE SUPPORTING STRUT FOR A LIGHT-EMITTING MEANS

FIELD

A luminaire including a luminaire base, an elongate, length-adjustable supporting strut held by means of the luminaire base, and a lighting means arranged on the supporting strut is generally dislcosed.

BACKGROUND

A multitude of different designs exist in the prior art in the development of luminaire technology. In addition to a good light yield, functionality and lightweight design, in particular, are a frequently demanded criterion. In particular in the case of, for example, workplace or reading luminaires comprising a lighting means attached to a supporting strut, there is a demand for individual adjustability of the position and/or the orientation of the lighting means by means of adjusting the supporting strut. For this purpose, designs are known from the prior art in which the length of the supporting strut can be adjusted.

For example, a luminaire with a supporting strut is already known from the utility model specification DE 202 10 215 U1 in which the supporting strut is configured to be length-adjustable and is formed at least partially from a band-shaped, biased material that can be transformed from a stable extended position into a rolled-up position and vice versa.

However, the design known from DE 202 10 215 U1 is disadvantageous in that it is difficult in practice to provide a supporting strut that can be rolled-up and which, in its extended position, exhibits sufficient mechanical stability.

SUMMARY

Disclosed is a luminaire which, while maintaining the functionality of the luminaire known from DE 202 10 215 U1, has a significantly improved mechanical stability of the supporting strut.

This is achieved by a luminaire having the features of the main claim. Advantageous embodiments and developments are apparent from the dependent claims.

In an exemplary embodiment, a luminaire as disclosed includes a luminaire base and an elongated, length-adjustable supporting strut held by the luminaire base. Furthermore, the luminaire may include a lighting means arranged on the supporting strut. Within the context of the present application, the term luminaire base is supposed to be understood to include all devices that are suitable as a standing or mounting means of the luminaire. Moreover, the supporting strut does not have to be disposed directly on the luminaire base, but can also extend at a distance thereto, with other supporting members being interposed.

In an exemplary embodiment, the supporting strut may include at least two bands that can each be transformed from a rolled-up position into an extended position or vice versa, that can be rolled up individually, and that are mechanically connected at at least one point in such a way that the bands mechanically support one another in the extended position. In this case, the bands in their extended position preferably have a low buckling resistance transverse to their extension direction in a first direction, and a high buckling resistance in a second direction opposite to the first direction. Buckling resistance is to be understood to be the capacity of maintaining the extended position under the influence of a force directed in a transverse direction to the extension direction of the band. As was already mentioned, the supporting strut includes at least two bands that support one another in the extended position. This improves the design of the luminaire mentioned in the utility model DE 202 10 215 U1 in that no stable extended position of each individual band on its own is required anymore. Rather, a sufficient mechanical stability of the supporting strut in its extended position is the result of the fact that the bands that can be rolled up, which by themselves may possibly have no or insufficient stability, in particular buckling resistance, support one another in such a way that the result in total is a sufficient mechanical stability.

Bands that have a profile which has a high buckling resistance transverse to the extension direction in a first direction, and a significantly reduced buckling resistance in a direction perpendicular thereto, which is also oriented transversely to the extension direction, have proved to be particularly suitable. Arcuate profiles, in particular U and V profiles, may be mentioned by way of example, but also W profiles or wave-shaped profiles in general have this advantageous property. If such profiles are used, in particular, "back-to-back", with, however, other configurations also being possible in principle, and if the bands are mechanically connected to one another at at least one point, then they stiffen relative to one another, so that a supporting strut consisting of at least two, possibly also three, four or more bands has a high mechanical strength, in particular a high buckling resistance in all directions transverse to the extension direction of the supporting strut. In this case, it is particularly advantageous if the direction of a low buckling resistance of the bands is oriented in the horizontal direction.

Due to the use and the specific arrangements of the at least two bands, the buckling resistance of the entire strut is increased while the design is significantly simplified at the same time. In addition to cost advantages, this makes it possible to considerably increase the maximum length of the supporting strut. This considerably increases the functionality of the luminaire because it can now be used, for example, as a table, floor or ceiling lamp with a variable lighting-means position.

In the case of the present luminaire, it can preferably be provided that the rolled-up part of the supporting strut is disposed in the luminaire base, particularly that it is held by it. Apart from design-related reasons, it is advantageous also for practical reasons to conceal the rolled-up state of the bands in the luminaire base because the bands are protected against the deposition of dirt.

Moreover, the luminaire base can advantageously be configured in such a way that it is suitable for attaching the luminaire to, for example, a wall or ceiling surface or to a panel of a piece of furniture.

As a rule, each band of the supporting strut will have a different cross section in its rolled-up state than in its extended position. This means that a change of shape of the bands that is to be caused mechanically is required when pulling out the supporting strut or pushing it in. Since this change of shape is essential for the behavior of the supporting strut when it is pulled out, it has furthermore proved to be advantageous if the luminaire base comprises shaping means provided for changing the cross-sectional shape of one band, respectively, when the supporting strut is pulled out or pushed in. For this purpose, the luminaire base can comprise, for example, a shaping area for an insertable part of the bands, by means of which the bands, due to the shape of the shaping area, can be continuously transformed from the cross-sectional shape in the rolled-up position into their cross-sectional shape in their extended position and vice versa. Accordingly, the shaping area serves as a guide for transforming the supporting strut from an extended into a rolled-up position. The user of the luminaire therefore only has to apply a force in the longitudinal direction of the supporting strut. The rearrangement processes which are carried out during the transformation from the extended into a rolled-up position are in that case taken care of by the shaping area.

Finally, it can be provided additionally that the supporting strut can be pivoted relative to the horizontal about an axis of rotation, and in particular that it can be fixed in an angular position desired by the user. In this way, the supporting strut can not only be adjusted with regard to its length, but is also able to assume any angular position. In this case, the pivot axis is preferably located in the area of the luminaire base and is oriented horizontally.

One option of connecting the bands at at least one point-includes of drilling through them in one place and connecting them in a positive fit by means of a screw. However, a substance-to-substance connection, e.g. by welding (e.g. by means of a welding spot), gluing (e.g. by means of a glue dot) or compressing, or also through a positive-fit connection, such as a latching engagement is also possible in principle. Preferably, the at least one mechanical connection point is disposed on the outer end of the supporting strut. Furthermore, it can provide a mechanical connection with the lighting means or the luminaire head.

Moreover, the bands can be electrically conductive. This embodiment leads to no separate electrical lines being required or visible. This embodiment is advantageous for design-related reasons. According to one version, the bands can also be electrically insulated from one another. In this embodiment, the at least one mechanical connection between the bands is preferably configured to be electrically non-conductive. In this embodiment in particular, a safety cut-out can be integrated into the luminaire. This can be integrated into the luminaire in the form of a monitoring device which measures the line resistance of the bands and, optionally, of the lighting means. If the measured resistance changes in a substantial extent, which could occur, for example, in case the bands buckle, i.e. a mechanical failure of the supporting strut, the monitoring device automatically switches off the power supply of the lighting means. In this case, a monitoring device can be integrated, in particular, into an electronic ballast of the lighting means.

BRIEF DESCRIPTION OF THE FIGURES

Exemplary embodiments of the present disclosure will be explained below with reference to the drawing. In the drawing:

FIG. 1 shows a schematic side view of a luminaire according to the dislcosure, FIG. 2 shows a top view of the luminaire according to FIG. 1.

DETAILED DESCRIPTION

Figure 3:
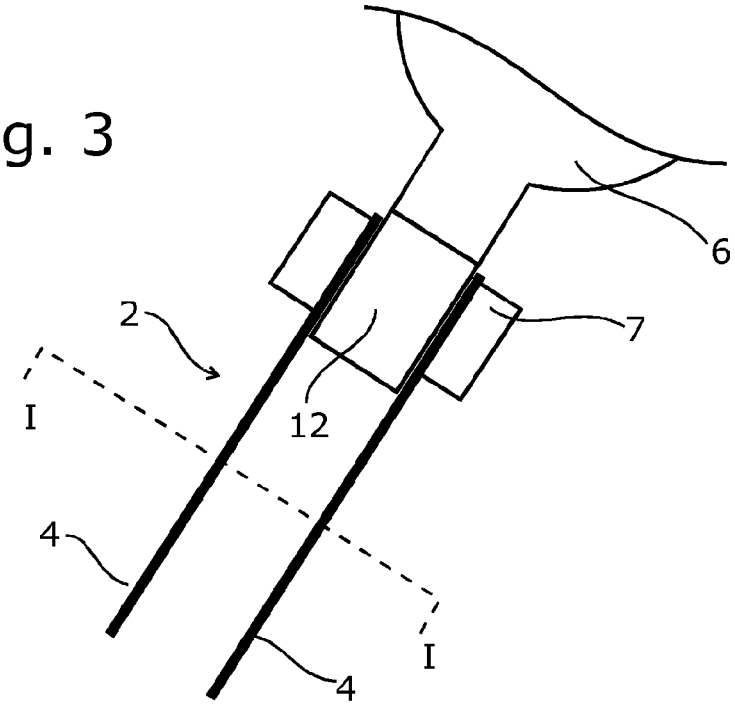
FIG. 3 shows an enlarged section from FIG. 2.

On the one hand, FIG. 1 shows an exemplary embodiment of a luminaire 100, which substantially comprises a luminaire base 1, a supporting strut 2, which extends upwards at an adjustable angle relative to the horizontal, and a luminaire shade 6 disposed at the free end of the supporting strut 2 which accommodates a lighting means 3, e.g. a light bulb, a fluorescent lamp or a modern semiconductor-based lighting means.

The luminaire base 1 is configured as a hemispherical housing in which the rolled-up part of the bands 4 and the associated roll-up mechanism 15, a pivoting device 13 and an electronic ballast 14 for driving the lighting means 3 are provided.

In the luminaire 100 according to FIG. 1, the supporting strut 2 consists of two bands 4 that can be transformed from an extended position into a rolled-up position. In this position, the rolled-up ends of the bands 4 are accommodated completely in the roll-up mechanism 15 and thus disappear virtually completely in the luminaire base 1. The bands 4 are formed from a metal sheet (e.g. of spring steel) with a thickness of typically less than 1 millimeter, preferably less than 0.5 millimeter, with the bands 4 being electrically insulated from one another by a paint coating or plastic coating applied on all sides. The bands 4 serve as electrical supply lines for the lighting means 3.

The mechanical connection between the luminaire shade 6 and the supporting strut 2 is shown in FIG. 3, which constitutes an enlargement of a detail of FIG. 2. As is apparent from FIG. 3, the bands 4 are connected on their outer end with an elongate attachment projection 12 of the luminaire shade 6 by means of a screw 7. An articulated connection between the luminaire shade 6 and the supporting strut 2 is thus realized. Moreover, the attachment projection 12 is divided in a direction transverse to its longitudinal axis, with the two parts being suitably mounted on each other so as to be rotatable relative to each other about the common longitudinal axis. This results in the adjustability of the luminaire shade 6, which is indicated in FIG. 1 by corresponding arrows on the luminaire shade 6, i.e. a rotatability of the luminaire shade 6 relative to the longitudinal axis of the supporting strut 2 and a pivotability of the luminaire shade 6 relative to the horizontal.

Figure 5:
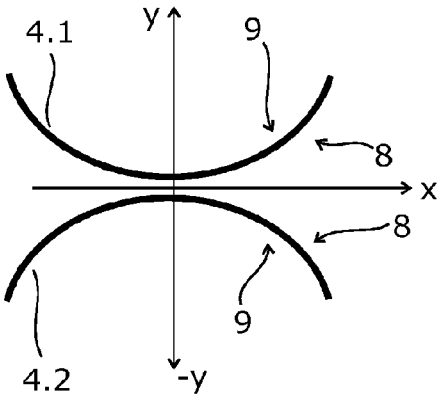
FIG. 5 shows an enlarged sectional view cut along the line I-I from FIG. 3.
Figure 7:
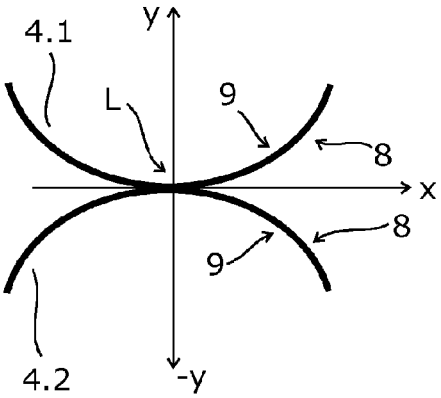
FIG. 7 shows an enlarged sectional view cut along the line III-III from FIG. 3*a*.
Figure 8:
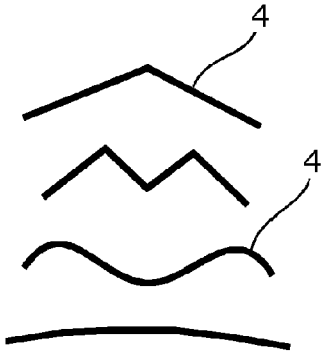
FIG. 8 shows enlarged sectional views of different bands with an arcuate cross section in the sense of the present disclosure.

Moreover, the screw 7, in cooperation with the attachment projection 12, constitutes a point-shaped mechanical connection between the bands 4 via which the bands 4 support each other. In this case, the attachment projection 12 holds the ends of the bands at a certain distance from each other so that a section through the bands 4 along the line I-I in FIG. 1 yields the view according to FIG. 5. It is also apparent from this Figure that in the extended state, each band 4 has an arcuate cross section in a direction transverse to its extension direction, as is apparent from FIG. 7, which shows a sectional view through the supporting strut 2 along the line I-I in FIG. 1. This arcuate cross section causes each individual band 4 to have a significantly lower buckling resistance in the y-direction according to FIG. 7, which extends transversely to the extension direction, than in the x-direction, which also extends transversely to the extension direction. Furthermore, the arcuate cross section causes the buckling resistance of the band, which in FIG. 5 is marked with 4.1, is significantly lower in the y-direction than in the opposite negative y-direction. Bands 4 whose cross sections correspond to one of the cross sections indicated schematically in FIG. 8 also exhibit comparable properties. In this case, the cross sections shown in FIG. 8 are to be understood only to be examples, and not a final list of suitable cross-sectional shapes.

Figure 3A:
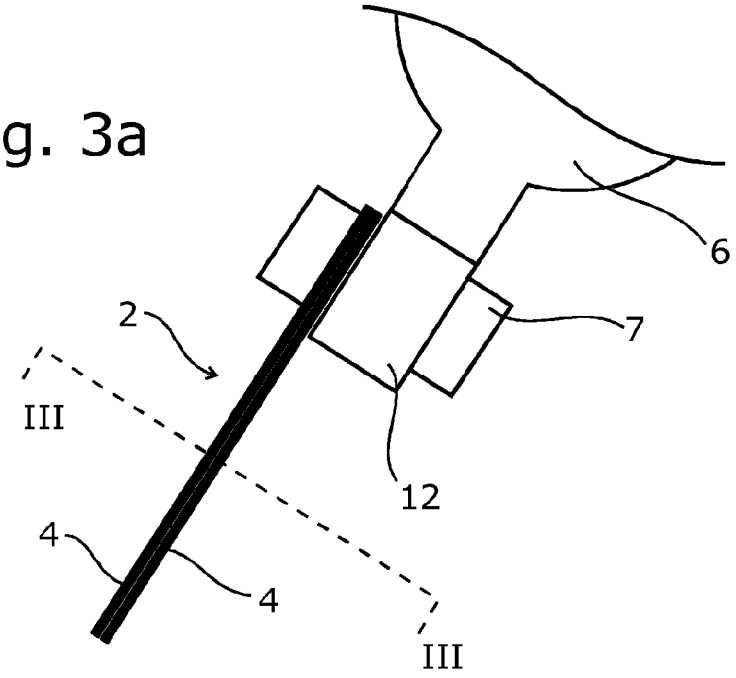
FIG. 3*a* shows an illustration of an alternative embodiment of the supporting strut in a view analogous to FIG. 3.

FIG. 3*a* shows an alternative configuration of a supporting strut 2 of a luminaire 100. In this alternative configuration, the arcuate bands 4 are oriented with their backs 9 against each other, so that they mechanically support each other with their backs 9 along a contact line L, as is apparent from the sectional view according to FIG. 7, which shows a section along the line II-II in FIG. 3*a*. This leads to a buckling resistance of the supporting strut 2 as a whole which is increased once again, compared with the configuration according to FIG. 3, both in the positive as well as in the negative y-direction.

A variant of the luminaire strut 2 that has a high mechanical load capacity results from the configuration of the bands 4 in accordance with FIG. 5. During the transformation of the bands 4 into the cross-sectional shape according to FIG. 5, a greater tension in the transverse direction, i.e. perpendicular to the cross section shown, is generated on the inner surface 9 of the bands 4, and an elongation is generated on the outer surface 8. The tensions in the longitudinal direction are compensated and are substantially identical, so that the bands 4 have a straight longitudinal extent and thus form the extended part of the supporting strut 2 shown in FIGS. 1 and 2. The arcuate cross section of the bands 4 shown in FIG. 5 (or also a cross section according to FIG. 8) leads to a very good buckling resistance of the entire supporting strut 2. In the embodiment according to FIG. 7, moreover, the stability of the supporting strut 2 is again increased by the bands 4 contacting each other with their outer surfaces 8, thus mechanically supporting each other additionally along an extended contact line.

Figure 6:
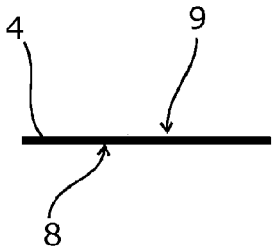
FIG. 6 shows an enlarged sectional view cut along the line II-II from FIG. 4.

In the rolled-up state, the bands 4 are generally shaped straight in cross section (see FIG. 6). However, this is optional; in principle, a change of the cross section of the bands 4 when they are being rolled up is not absolutely necessary. In this flat state, a greater tension is generated on the inner surface 9 of the band 4 than on the outer surface 8. However, the tensions on the inner surface 9 and on the outer surface 8 are substantially identical perpendicular to the cross section shown, so that the straight shape is assumed.

Each band 4 is associated with its own roll-up mechanism 15, as is apparent from the top view according to FIG. 2. In this case, each roll-up mechanism 15 is configured in the manner known from the prior art from metal measuring tapes that can be rolled up, which, when not in use, can be retracted into the housing and rolled up therein, for example driven by spring force.

One option of increasing the functionality of the luminaire is to configure the supporting strut 2 so as to be pivotable relative to the horizontal. For this purpose, a pivoting device 13 is disposed in the luminaire base 1 on which the two roll-up mechanisms 15 of the two bands 4 are jointly mounted, so that the bands 4 can be jointly pivoted about a horizontal axis of rotation P in their extended position. Preferably, the pivoting device 13 is in this case configured to be self-locking, so that the supporting strut 2 is held in any angular position desired by the user, irrespective of its extended length. In this case, the pivoting device is apparent from FIGS. 1, 2 and 4.

Figure 4:
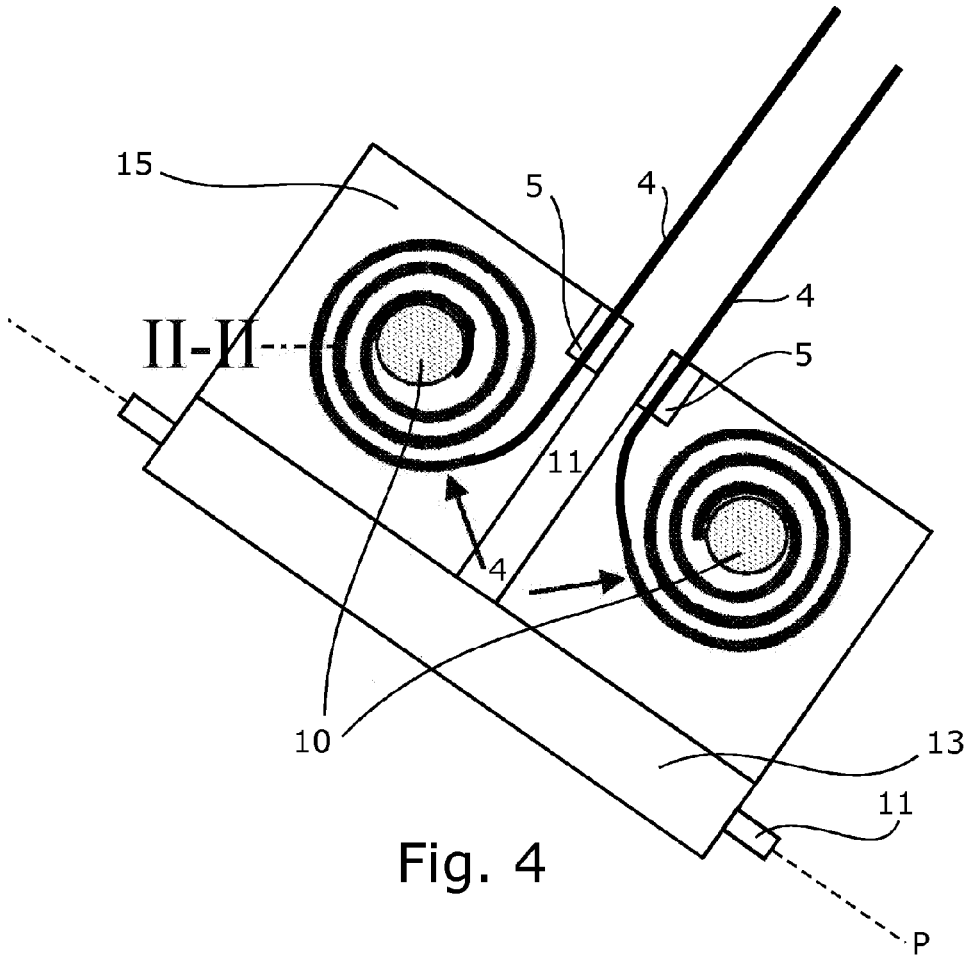
FIG. 4 shows a schematic illustration of the roll-up mechanisms for accommodating the rolled-up ends of the bands.

Each roll-up mechanism 15 in turn comprises a rotatably mounted shaft 10 on which one band 4, respectively, can be rolled up, as is apparent from FIG. 4. In this case, each band 4 is mechanically biased individually against its extended direction by means of a spring (not shown) acting on the respective shaft 10. At the same time, each roll-up mechanism 15 is configured to be self-locking in such a way that each band 4 is mechanically locked in any extended state desired by the user.

Moreover, each roll-up mechanism 15 respectively comprises a shaping area 5, as is schematically indicated in FIG. 4. When the supporting strut 2 is being pulled out, the shaping area 5 provides for the shaping of the bands 4 from the straight cross section according to FIG. 6 into an arcuate cross section, e.g. in accordance with FIG. 5 or 7, and when the supporting strut 2 is retracted, for the shaping of the bands 4 from an arcuate into a straight cross section.

Furthermore, the two roll-up mechanisms 15, which are disposed next to each other in a common plane, are jointly attached to a pivoting device 13 whose functionality was already described above. This pivoting device 13, forming an axis of rotation P, is rotatably mounted on a shaft 11, which in turn is non-rotatably connected to the housing of the luminaire base 1.

The mode of operation of the above-described luminaire will be briefly explained below:

The supporting strut 2, at least with regard to the part thereof extended from the luminaire base 1, is configured to be length-adjustable. By applying a manual force in the longitudinal direction of the supporting strut 2, it can either be pushed into the luminaire base 1, so that the lower ends of the bands 4 roll up around the shaft 10, which is rotatably mounted in the luminaire base 1. Moreover, the supporting strut 2 can be pulled out for the purpose of extending it. This is shown by the double arrow in FIG. 1. The angle of the supporting strut 2 relative to the horizontal can be changed by the user, as is indicated by the dashed double arrow in FIG. 1.

Figure 9:
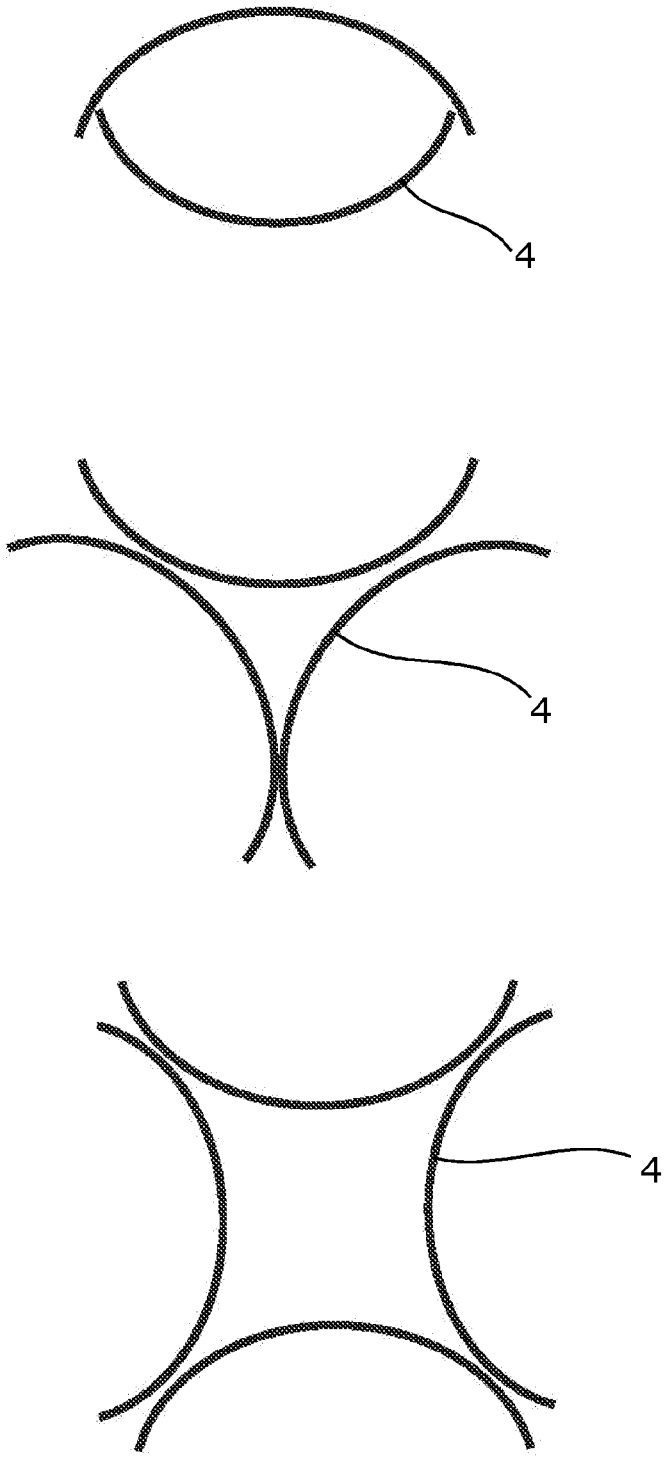
FIG. 9 shows different alternative band configurations of two and more bands with an arcuate cross section.

Finally, FIG. 9 shows different alternative band configurations of two and more bands 4 with an arcuate cross section for forming the supporting strut 2. Among other things, it is apparent from this Figure that the band configuration "back-to-back" shown in the preceding exemplary embodiment is not obligatory. Moreover, it is apparent from the Figure how the "back-to-back" configuration of FIG. 5 can be developed further for configurations with three or four bands 4, in which the bands 4 are again mechanically connected to at least one adjacent band 4 at least at one point.

The invention claimed is:

1. A luminaire comprising:

a luminaire base;

an elongate, length-adjustable supporting strut held by means of the luminaire base; and a lighting means arranged on the supporting strut, wherein the supporting strut includes at least two bands that are transformable from a rolled-up position into an extended position or the extended position to the rolled up position, the at least two bands being individually rollable into the rolled up position, and mechanically connected at at least one point in such a way that the bands mechanically support one another in the extended position at at least the one point, wherein the at least two bands have an arcuate cross section in the extended position, and wherein outer surfaces of the arcuate cross section of the at least two bands are disposed so as to adjoin each other in the extended position of the at least two bands.

2. The luminaire according to claim 1, wherein each of the at least two bands, in the extended position, includes a low buckling resistance in a first direction extending transversely to its extension direction, and includes a high buckling resistance in a second direction opposite to the first direction.

3. The luminaire according to claim 2, wherein the at least two bands are a first and a second band, with the first band supporting itself on the adjacently disposed second band in the direction in which the first band has a high buckling resistance, and vice versa.

4. The luminaire according to claim 1, wherein the rolled-up part of the at least two bands is disposed in the luminaire base.

5. The luminaire according to claim 1, wherein the luminaire base includes a shaping area for an insertable part of at least one of the at least two bands of the supporting strut by means of which the at least one of the at least two bands is transformable from its cross-sectional shape in the extended position into the cross-sectional shape in the rolled-up position and vice versa.

6. The luminaire according to claim 1, wherein the at least two bands of the supporting strut are electrically conductive and serve as an electrical supply line for the lighting means.

7. The luminaire according to claim 1, wherein the at least two bands are electrically insulated from one another.

8. The luminaire according to claim 1, wherein the arcuate cross-section of each of the at least two bands is taken in a direction transverse to an extension direction of each of the at least two bands.

* * * * *